United States Patent [19]

Neward

[11] Patent Number: 4,544,063

[45] Date of Patent: Oct. 1, 1985

[54] CLOSURE FOR RECEPTACLE

[76] Inventor: Lance M. Neward, 9251 Archibald, Cucamonga, Calif. 91730

[21] Appl. No.: 658,151

[22] Filed: Oct. 5, 1984

[51] Int. Cl.[4] ..... B65D 83/04

[52] U.S. Cl. ..... 206/540; 206/528; 220/253; 222/519

[58] Field of Search ..... 206/528, 540; 220/253; 222/513, 516, 519

[56] References Cited

U.S. PATENT DOCUMENTS 1,714,368 5/1929 Hobson ..... 220/253 X 2,214,437 9/1940 Punte et al. ..... 220/253 X 2,328,246 8/1943 Albion ..... 220/253 X 3,871,522 3/1975 Feldman ..... 206/540

*Primary Examiner*—Steven M. Pollard

*Attorney, Agent, or Firm*—Lyon & Lyon

[57] ABSTRACT

A receptacle which may be locked in either a closed or an open position having a cap attached by at least one locking tab to a container, the cap being biased away from the container, said receptacle being capable of varying degrees of restraint toward movement between the open and the closed positions.

15 Claims, 8 Drawing Figures

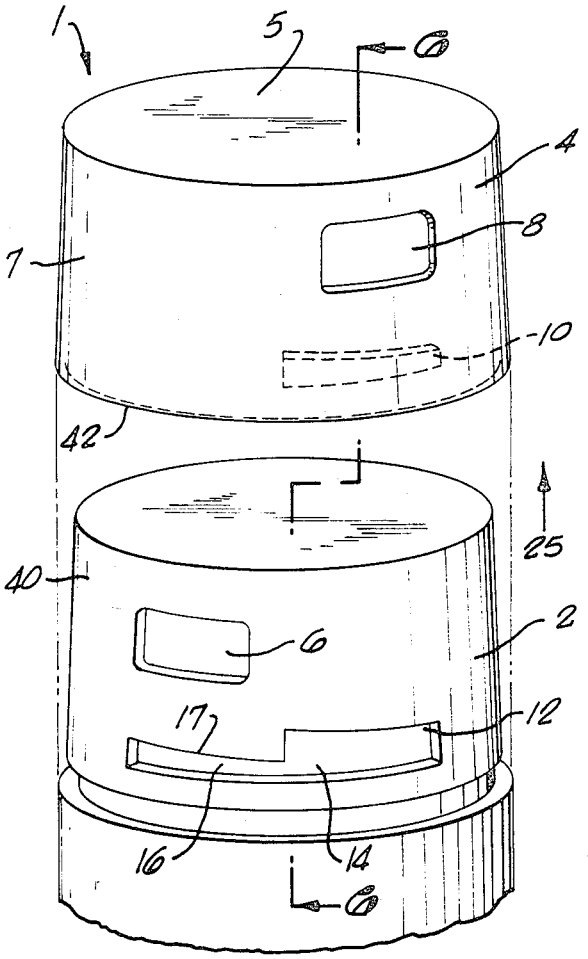
FIG. 1.
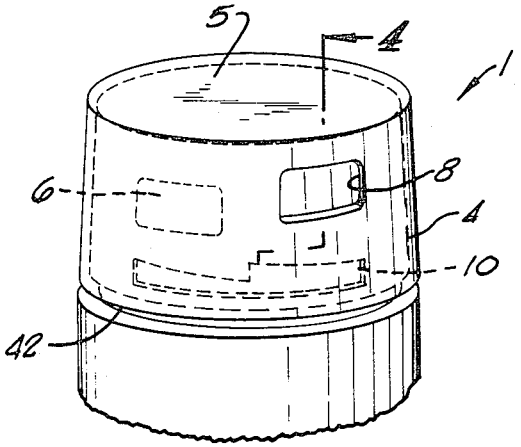
FIG. 2.
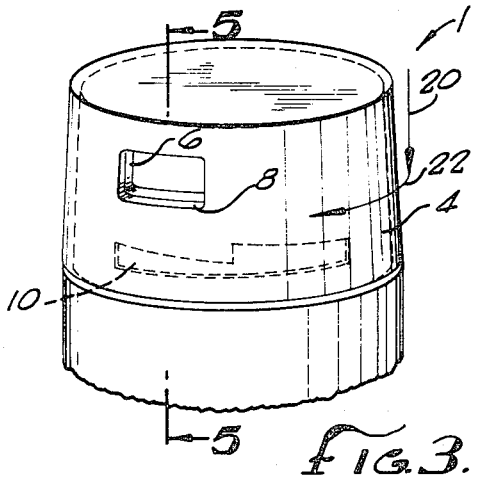
FIG. 3.
FIG. 4.
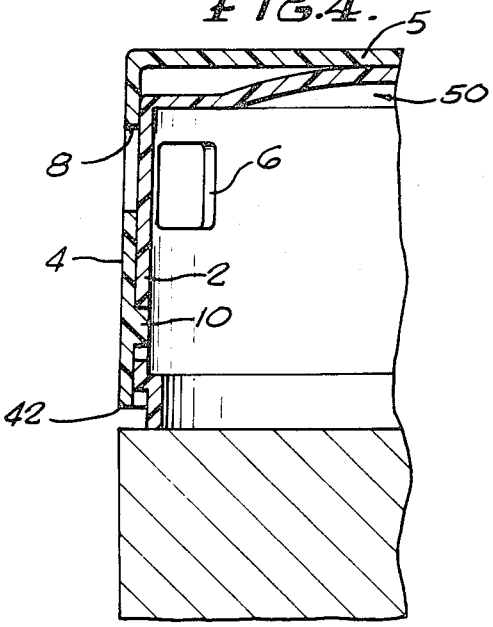
FIG. 5
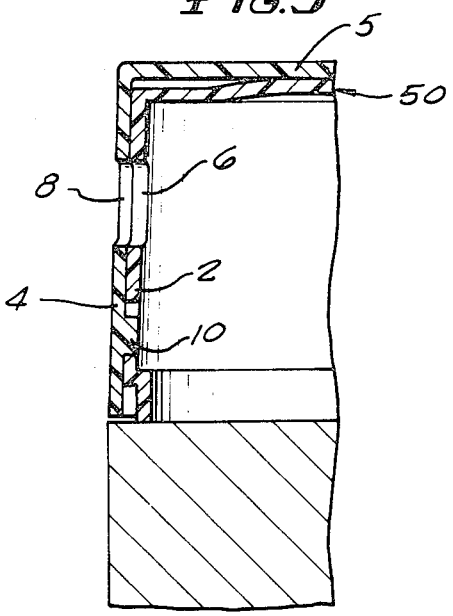

CLOSURE FOR RECEPTACLE

BACKGROUND OF THE INVENTION

1. Field of the Invention

The present invention is directed to a closure for a receptacle containing no loose parts. More specifically, the cap is attached to the container so as to form a receptacle which may be locked in either an open or in a closed position without removal of the cap from the receptacle.

2. Description of the Prior Art

Most pill bottles and similar such devices currently existing utilize a cap and a container, the cap being separable from the container. Such a construction has the distinct disadvantage that the cap may become lost, dirty or contaminated when removed from the container. Additionally, when the cap of the container is removed, there will exist a large opening at the top of the container which was formerly enclosed by the cap. This large opening will also allow the container and/or its contents to become contaminated or dirty.

It is known that a dispensing opening for a pill bottle may be provided on the vertical portion of a cap. In U.S. Pat. No. 662,353 a vessel for powdered or granulated material is described wherein the vessel has registered openings in the vertical side wall portions of the vessel and a cover to form a dispensing opening. The two parts may be converted to a unitary construction by reaming or crimping the edge of the cap into the vessel. U.S. Pat. No. 1,775,959 discloses a dispensing receptacle with a removable top wherein the receptacle also has registered openings in the vertical side wall portions to form a dispensing opening. However, both of these patents disclose receptacles wherein a horizontal rotation aligns the registered openings and there is no locking position to ensure that the openings will remain in the open or closed position.

Previous devices have also been designed wherein the cap is displaced vertically so as to align dispensing openings. In U.S. Pat. No. 3,305,145 a dispensing container is disclosed with two annular processes which receive a projection and retain a cap in product dispensing and body closing positions. In U.S. Pat. No. 4,295,584 a side dispensing disclosure is disclosed wherein the container can be opened by a pull-up slide arrangement designed into the container and closure. However, neither of these patents is directed to a receptacle in which the degree of difficulty of either opening or closing the cap may be varied between the range of extreme difficulty to very little or substantially no difficulty. Instead, these references are merely directed to dispensing openings. Neither reference discloses a locking mechanism wherein the cap must overcome vertical as well as horizontal restraints in order to change the locked position of the cap between an open and a closed position.

It is also known that pill bottles may be provided with a spring so as to bias the cap of the pill bottle. In U.S. Pat. No. 3,355,067, a rotatable cap alignable with dispensing openings in the container is provided with a relatively complex locking mechanism designed to indicate the last previous time when the dispenser was opened. In U.S. Pat. No. 3,871,522, a spring is utilized to form a self-closing safety container for medicinal tablets wherein the cap and the container will be held in a non-aligned position by means of a spring unless the cap is turned in a circular direction against the pressure of the spring. Neither of these patents is directed to a receptacle which may be locked in a closed or in an open position, a change in position requiring both vertical as well as horizontal movement so as to overcome a transition mechanism which may be of variable difficulty with respect to the desired change in position.

SUMMARY OF THE INVENTION

Thus, it is an object to provide an improved receptacle closure.

It is another object of the present invention to provide a receptacle with a simple and economical construction in which a vertical dispensing opening is provided which may be locked in either an open or in a closed position.

It is another object of the present invention to provide a container which has no loose parts which may become lost or contaminated. Thus, the cap of the present invention may not be removed from the receptacle.

It is a further object of the present invention to provide a receptacle in which the degree of difficulty in opening or closing the receptacle may be varied. In similar manner, a child-proof receptacle may be obtained.

In the present invention, a cap is affixed to a container by at least one locking tab which is maintained within a first "closed" or locking slot, a second slot defining an open position for the receptacle, or a transitional slot therebetween. Once the cap has been affixed to the container, the locking tab(s) will prevent the cap from being removed. An integral spring biases the cap and the container so as to provide resistance to movement of the cap in a downward vertical direction relative to the base of the cylindrical container. By modifying the shape and/or relative position of the locking slots, it is possible to make the device a hard-to-open, easy-to-close cap; a hard-to-open, hard-to-close cap (locking open or closed); or an easy-to-open, hard-to-close cap.

In the present invention, only a side opening in the receptacle is open to the outside of the container. Because this opening is vertical, and because only a relatively small opening is exposed, the contents of the container are much less likely to become contaminated than with a full-top opening.

BRIEF DESCRIPTION OF THE DRAWINGS

FIG. 1 is an exploded perspective of a preferred embodiment in a closed position;

FIG. 2 is an assembly drawing of the receptacle shown in FIG. 1 in a closed position;

FIG. 3 is an assembly drawing of the receptacle shown in FIG. 1 in an open position;

FIG. 4 is a partial cross section taken along section cut line 4—4 of FIG. 2;

FIG. 5 is a partial cross section taken along section cut line 5–5 of FIG. 2;

DESCRIPTION OF THE PREFERRED EMBODIMENT

Figure 6:
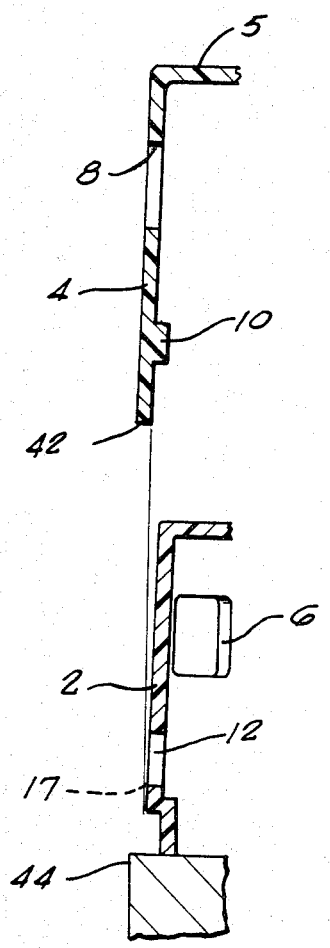
FIG. 6 is an exploded partial cross section of FIG. 4.

A preferred embodiment of this invention is depicted in FIGS. 1–8 in which the device is a hard-to-open, hard-to-close cap. As seen in FIG. 1, the top 4 has been removed from the main body 2. The main body is shown as an enclosed container with an inner side opening 6 and a tab movement zone, generally depicted as 11. The tab movement zone includes an area defining a closed slot 12, an area defining a transition slot 14 and an area defining an open slot 16. This position is defined as an "open" position. Although an inner cap 40 has been placed on the main body, it is not necessary that the inner cap be solid.

The top 4 has an outer lid 5 and cylindrical side wall 7. A locking tab 10, an outer side opening 8 and a locking ridge 42 may also be formed in the top. When the top 4 is affixed to the main body 2, the locking tab 10 will be held within the tab movement zone 11. When the locking tab 10 is in open slot 16 as shown in FIG. 3, an inner side opening 6 and an outer side opening 8 will be at least partially aligned so as to allow access to the inside of the main body 2. In this position, articles may be introduced or removed from the receptacle 1. This position is defined as an "open" position.

If the locking tab 10 is in either transition slot 14 or closed slot 12, inner side opening 6 and outer side opening 8 will be nonaligned. In either of these positions, top 4 will prevent the introduction of articles into receptacle 1 while also preventing removal of the contents of the receptacle. When the locking tab 10 is in the closed slot 12 as depicted in FIG. 2, locking ridge 42 of top 4 will protrude into locking groove 44, shown in FIG. 1, of main body 2 to prevent removal of top 4 from the main body. This position is defined as a "closed" position. However, it should be understood that the locking ridge 42 and locking groove 44 are optional since the top would still be restrained by movement of the locking tab within the tab movement zone. Further, additional restraint could be provided by one or more additional locking tabs and movement zones. It should also be understood that a locking tab could be placed in the main body while a tab movement zone could be placed or embedded in the top. Alternatively, a first locking tab could be placed in the main body while a first tab movement zone could be placed or embedded in the top or a second locking tab could be placed in the top while a second tab movement zone could be placed or embedded in the main body.

The mechanism for locking the top in an open or in a closed position may be designed so as to vary the difficulty of moving the locking tab between the open and closed slots. As shown in FIGS. 4 and 5, an integral spring 50 may be formed by the inside of outer lid 5 or by the top of inner cap 40 or by a combination of both. This spring will bias the top in the direction of arrow 25 shown in FIG. 1. Thus, unless a force is applied in the direction of arrow 20 shown in FIG. 3, when locking tab 10 is in transition slot 14 directly beneath locking slot 12, integral spring 50 will bias locking tab 10 into closed slot 12. Additionally, spring 50 will also bias the locking tab 10 against the upper ridge 17 of open slot 16 when the locking tab is in the open slot. When the locking tab 10 abuts upper ridge 17, tab movement stop 46, shown in FIG. 1, prevents closure of the receptacle by rotation of the locking tab into the transition slot. Thus, to move the locking tab into the transition slot, a force must be applied in the direction of arrow 20 while the top is turned opposite the direction of arrow 22 shown in FIG. 3. It should be noted the spring 50 may be integral with the top 4, the main body 2 or it may be formed by a first spring portion integral with the top 4 and a second spring portion integral with the main body 2.

Figure 7:
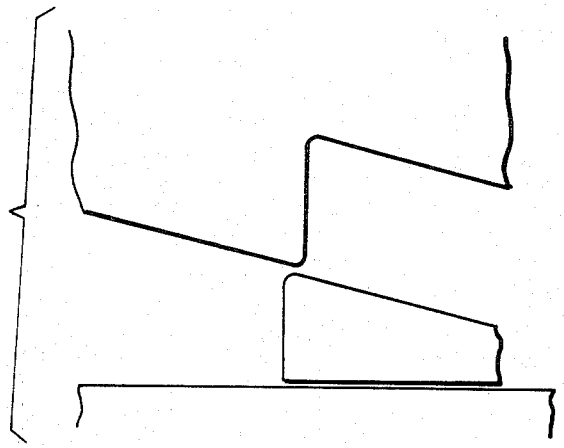
FIGS. 7 and 8 are schematic diagrams.
Figure 8:
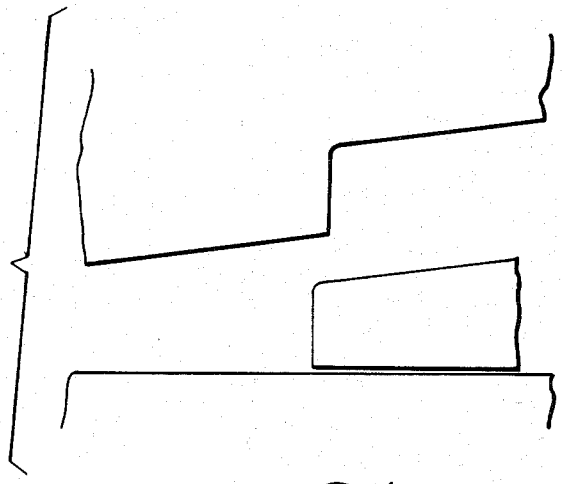

To make it easier to close the receptacle, as shown in FIG. 7, open edge 47 of movement stop 46 may be tapered or slanted. To make it easier to open the receptacle, as shown in FIG. 8, closed edge 48 of movement stop 46 may also be tapered or slanted in a similar fashion. By varying the taper, or lack thereof, of open edge 47 and closed edge 48, a wide variance of degree of difficulty may be imparted to the ease with which the receptacle may be opened or closed. An additional degree of difficulty in opening or closing the receptacle will be achieved when the strength of spring 50 is increased or the length of a tab movement stop 46 is increased so that it must be compressed and/or resiliently deflected to permit movement of the tab between the open slot and the transition slot.

While a preferred application of this invention has been shown and described, it would be apparent to those skilled in the art that many more modifications are possible without departing from the inventive concept herein described. The invention, therefore, is to be limited only by the lawful scope of the claims that follow.

That which is claimed is:

1. A receptacle, comprising:

a cylindrical container, comprising a base, a cylindrical sidewall connected to the base and a first opening in the cylindrical sidewall;

a cap connected to the container, comprising an outer top, an outer sidewall connected to the outer top and a second opening in the outer sidewall;

a cap retention means connecting the container and the cap, said retention means preventing removal of the cap from the container;

biasing means applying a force on the cap to urge the cap away from the container;

means for allowing rotation of the cap about the cylindrical sidewall;

means for allowing the cap to be vertically displaced relative to the base;

a first stop means which maintains the cap and the container in a closed position in which the first opening and the second opening are totally non-aligned to prevent access to the interior of the container, said first stop means preventing substantial movement of the cap absent an external force applied to the receptacle to overcome the force applied by the biasing means and the resistance provided by the rotation lock means; and rotation lock means, said lock means providing resistance to rotation of the cap about the cylindrical sidewall from a first position wherein the first and second openings are totally non-aligned to a second position wherein the first and second openings are at least partially aligned.

2. A receptacle as recited in claim 1, further comprising a second stop means which maintains the cap and the container in a second open position which at least partially aligns the first opening and the second opening to provide an acccess to the interior of the container, said second stop means preventing substantial movement of the cap absent an external force applied to the receptacle to overcome the force applied by the biasing means.

3. A receptacle as recited in claim 1, wherein the cap retention means comprises the rotation lock means.

4. A receptacle as recited in claim 1, wherein the biasing means comprises an integral spring, said spring being integral with the cap.

5. A receptacle as recited in claim 1, wherein the biasing means comprises an integral spring, said spring being integral with the container.

6. A receptacle as recited in claim 1, wherein the biasing means comprises a first spring portion integral with the cap and a second spring portion integral with the container.

7. A receptacle as recited in claim 1, wherein the external force that must be applied to the receptacle to move the cap from the open position to the closed position is greater than the external force that must be applied to move the cap from the closed position to the open position.

8. A receptacle as recited in claim 1, wherein the external force that must be applied to the receptacle to move the cap from the closed position to the open position is greater than the external force that must be applied to move the cap from the open position to the closed position.

9. A receptacle, comprising:

a cylindrical main body comprising a base, a cylindrical sidewall and an inner side opening formed in the sidewall;

a tab movement zone in the sidewall, said zone comprising an area defining an open position, an area defining a transition position contiguous with the open position and an area defining a closed position contiguous with the transition position, the area defining the open position being separated from the area defining the closed position by the area defining the transition position;

a cap connected to the main body comprising a lid, a cylindrical wall portion and an outer side opening formed in the cylindrical wall portion;

a locking tab connected to the cylindrical wall portion, the locking tab being confined within the tab movement zone, movement of the cap being limited by movement of the tab within the tab movement zone, the inner side opening and the outer side opening being at least partially aligned so as to provide a dispensing opening in the receptacle providing access to the inside of the main body when the tab is in the area defining an open position, the inner side opening and the outer side opening being non-aligned so as to prevent access to the inside of the main body when the tab is not in the area defining the open position;

a transition restraint integral with the main body, said transition restraint providing resistance to movement of the tab in the area defining a transition position; and a spring biasing the cap to urge the cap away from the main body.

10. A receptacle as recited in claim 8, wherein the biasing means comprises an integral spring, said spring being integral with the cap.

11. A receptacle as recited in claim 8, wherein the beiasing means comprises an integral spring, said spring being integral with the container.

12. A receptacle as recited in claim 8, wherein the biasing means comprises a first spring portion integral with the cap and a second spring portion integral with the container.

13. A receptacle as recited in claim 8, wherein the cylindrical main body further comprises an inner lid connected to the cylindrical sidewall whereby the inner side opening provides the only access to the interior of the main body when the locking tab is in the open position.

14. A receptacle as recited in claim 8, wherein the tab movement zone is embedded in the cylindrical sidewall but does not allow access to the interior of the main body.

15. A receptacle, comprising:

a container comprising a base and a cylindrical side body in which an inner opening, an area defining an open slot, an area defining a closed slot and an area defining a transition zone separating the area defining an open slot and the area defining a closed slot are formed in the cylindrical side body, the area defining an open slot and the area defining a closed slot being of unequal vertical distances relative to the base;

a cap for the container comprising a lid, a sidewall, a locking tab contiguous with the sidewall and an outer opening formed in the sidewall, the outer opening and the inner opening being at least partially aligned when the locking tab is engaged in the area defining an open slot, the outer opening and the inner opening being completely non-aligned when the locking tab is engaged in the area defining a closed slot, the locking tab preventing separation of the container from the top;

a horizontal movement stop formed in the side body contiguous with the area defining a transition zone, the vertical height of the area defining a transition zone between the sidewall and the horizontal movement stop being less than the vertical height of the locking tab relative to the base, said stop being located so as to provide resistance to movement of the locking tab between the area defining an open slot and the area defining a closed slot; and a biasing means between the container and the top, said biasing means providing resistance to movement of the locking tab toward the base.

* * * * *